US005734288A

United States Patent [19]

Dolazza et al.

[11] Patent Number: 5,734,288

[45] Date of Patent: Mar. 31, 1998

[54] APPARATUS FOR AND METHOD OF AUTOZEROING THE OUTPUT OF A CHARGE-TO-VOLTAGE CONVERTER

[75] Inventors: Enrico Dolazza, Boston; Hans Weedon, Salem; Roger Finch, Ipswich, all of Mass.

[73] Assignee: Analogic Corporation, Peabody, Mass.

[21] Appl. No.: 594,426

[22] Filed: Jan. 31, 1996

[51] Int. Cl.[6] ..... G06G 7/64

[52] U.S. Cl. ..... 327/337; 327/142; 327/319

[58] Field of Search ..... 327/91, 94, 142, 327/309, 319, 333, 336, 337, 341, 554

[56] References Cited

U.S. PATENT DOCUMENTS

| | | | |
|---|---|---|---|
| 4,163,947 | 8/1979 | Weedon | 328/128 |
| 5,053,770 | 10/1991 | Mayer et al. | 341/118 |
| 5,138,552 | 8/1992 | Weedon et al. | 364/413.5 |
| 5,397,936 | 3/1995 | Wang | 327/91 |
| 5,495,199 | 2/1996 | Hirano | 327/337 |
| 5,546,028 | 8/1996 | Yamaguchi | 327/91 |
| 5,572,154 | 11/1996 | Rakers et al. | 327/91 |

*Primary Examiner*—Timothy P. Callahan
*Assistant Examiner*—Jeffrey Zweizig
*Attorney, Agent, or Firm*—Lappin & Kusmer LLP

[57] ABSTRACT

The invention is an autozeroing circuit for use in processing low level electrical charge signals by an integrating operational amplifier. The autozeroing circuit includes a switching circuit that periodically charges and discharges the integrating capacitor of the amplifier during set and reset phases of an operation cycle so that during the set phase of the cycle the input signal is integrated and processed by processing circuitry including an A/D converter, and during the reset phase the integrator is cleared. The circuit includes a storage capacitor connected between the output of the operational amplifier of the integrator and the input to the processing circuitry, and a switch selectively operable to clamp the input of the processing circuitry to system ground during operation of the switching circuit in the amplifier so that the set phase of the cycle can begin with a known level of input (ground) at the input of the processing circuitry, independent of noise and artifacts attributed to the operation of the switching circuit in the integrator.

8 Claims, 1 Drawing Sheet

APPARATUS FOR AND METHOD OF AUTOZEROING THE OUTPUT OF A CHARGE-TO-VOLTAGE CONVERTER

FIELD OF INVENTION

The present invention relates generally to apparatus for autozeroing the output of a charge-to-voltage converter, and more particularly to such apparatus for use with input signals of very low amplitudes.

BACKGROUND OF THE INVENTION

While a number of autozeroing circuits are known and proven effective generally, such as those described in U.S. Pat. Nos. 4,163,947 and 5,053,770, their utility is seriously impaired when processing electrical signals of extremely low amplitude.

For example, digital or computed radiology is a known technique in which X-ray latent images are formed on a special substrate or plate rather than the usual X-ray film. In one form of computed radiology, the latent image is scanned with a laser and each image pixel is read out as an electrical charge. Computed radiology is superior to X-ray films for several reasons.

The substrate is typically erasable and reusable, while X-ray film is not. Secondly, physical examinations call for a predetermined level of X-ray energy, i.e., a peak voltage and maximum milliampere level for powering the X-ray source, and in the case of a pulsed X-ray source, the time duration of each pulse driving the pulsed X-ray source. If the parameters of the X-ray exposure are wrong the resulting X-ray image recorded on film tends to be either under or over exposed, because of the mismatch between the X-ray flux and the film dynamic range, resulting in poor diagnostic quality images.

Yet another advantage of computed radiology is that information derived from the latent image formed in the substrate intrinsically can be formed as a digital data file. The data is therefore easily stored in memory and archived, and more readily transferred quickly than information contained in X-ray film, without deterioration of data. Thus, various digital processing algorithms and techniques become available making it easier to process, such as spatial filtering and other image enhancement techniques.

A fourth advantage of computed radiology, at least with respect to certain substrate materials, is that the X-ray dosage can be reduced because the material used has a higher DQE than that of standard X-ray film.

In the U.S. the estimate of X-ray images recorded on film that are so poor as to require the retaking of the image ("recall") is estimated to be around 20%. Radiologists expect this number to go up, because of the poorer training and skills of X-ray technicians. On the other hand, in computed radiology the signals representative of pixels of a latent image on a plate can be digitized over a sufficiently large dynamic range so that one should not have to retake the X-ray image.

In a certain implementation of computed radiology, an exposed X-ray plate is scanned, for example by a laser beam, and each pixel defined area of the plate is read over a time of about 30 to 70 μsec to permit the full charge of the reading to be collected into a charge-to-voltage conversion device. The resulting voltages are then typically converted to digital format for storage, processing and display. Obviously, sequentially reading the typically millions of pixels for each plate into but a single information channel would be unduly time consuming. By using multiple (e.g. 64) channels or charge-to-voltage converters for reading the plate, one can considerably reduce the time required to read the plate.

Typically, to measure a charge representing a pixel of the latent image and convert it to a digital value, the prior art has employed a two-stage system, a first stage to convert the charge to an analog voltage and a second stage to process the analog voltage and convert it to a digital value. Such a prior art system is shown in FIG. 1, wherein the first stage includes a charge-to-voltage converter that comprises an integrator exemplified by a well-known integrating operational amplifier 20 having the usual inverting input terminal 22 for receiving the input signal representing the value of each pixel, non-inverting input terminal 24, output terminal 26, integrating capacitor 28 connected in a negative feedback path between terminals 26 and 22, and switch means, such as FET reset switch 30, connected in parallel to capacitor 28. A second stage is provided in the form of filter 32, the input terminal of which is connected to output terminal 26. The output terminal of filter 32 is connected to the input of amplifier 34. The analog output signal from the latter is preferably converted to digital form by A/D converter 36, amplifier 34 serving to adjust the voltage to match A/D converter 36. By closing the FET reset switch 30, the capacitor 28 can be cleared during the reset phase of an integration cycle, i.e., the integrator is cleared for the next reading. Opening the reset switch begins the set phase of an integration cycle during which time a charge is read by the integrator until such time as the reset switch is again closed.

Unfortunately, there are spurious phenomena that cause inaccurate readings at the output terminal 26 during the set phase of the integration cycle. These phenomena include noise and artifacts that shift the signal level at the output terminal 26 at the beginning of each set phase of the integration cycle to some unknown and unpredictable level. The sources of such noise and artifacts include charge injection from FET reset switch 30 due to the internal capacitance of the FET switch and the control voltage applied to the gate of the switch during the transition from the reset phase to the set phase of the integration cycle.

More specifically, FET switch 30 typically operates with a control signal on the order of approximately five volts, and because of the capacitance of the FET switch, typically on the order of one picofarad, an error signal on the order of 5 picocoulombs will be injected into the output terminal 26 of the amplifier 20 each time the switch is opened or closed. When this occurs at the beginning of the set phase of the integration cycle, this injected charge effects the value of the voltage applied to the input of filter 32. Although the injected charge is rather small, unfortunately, the amount of charge per pixel "Q" read out from computed radiology substrates also tends be quite small, e.g., the amount of charge per pixel is typically on the order of a few picocoulombs full scale, i.e., less than 5 or 6 picocoulombs.

Opening reset switch 30 will cause operational amplifier 20 to function as an integrator of a charge equal to Q (usually a few picocoulombs), with capacitor 28 being charged for some time T, e.g. 25 μsec, depending on the duration time of the set phase of the integration cycle, providing at output terminal 26 a voltage typically of Q/C, where C is the value in farads of capacitor 28. Thus, the smaller the value of capacitor 28, the greater amplification is obtained. For practical reasons, the value of integrating capacitor 28 is generally on the order of 20 to 30 picofarads when the circuit is implemented with discrete components (and on the order of one picofarad when the circuit is implemented as an integrated circuit), because lesser values tend to create problems in reading voltage signal levels at the output of the first stage of the system. Generally, the voltage appearing at the output of amplifier 20 (in the case of discrete components) at full scale will be on the order of 0.1 volt. The errors attributed to charge injection are therefore significant.

Further, once each signal Q is read, it is necessary to fully discharge capacitor 28 during the reset phase of the integration cycle so that a subsequent signal can be read and converted. Charging and discharging capacitor 28 constitutes yet another source of noise, the Boltzman noise $kT/C_f$ provided by feedback capacitor 28 to the output 26 of the amplifier 20. This Boltzman noise tends to increase when the value of the feedback capacitance $C_f$ of capacitor 28 decreases, although the noise results in an unknown level of the voltage output at the output terminal 26 of the amplifier 20, before integration of the input signal Q from the computed radiology device for storing the latent image.

Finally, other sources of noise and artifacts that result in unknown starting signal levels at the output terminal 26 of the amplifier 20 relate to the circuit interaction with the digital circuit before the start of the set phase of each integration cycle.

Thus, basically, then there are three problems associated with the operation of the circuit shown in FIG. 1 that result in inaccurate output signals of the integrator 20 during each integration cycle: (1) charge injection that can create artifacts greater than the full scale of the signal; (2) intrinsic noise specifically related to $kT/C_f$; and (3) other artifacts that result in unknown starting signal levels at the output of the integrator at the beginning of the set phase of each integration cycle. In order that the sequence of input signals Q, respectively representing the pixel data, be sequentially applied to the inverting input 22 of the operational amplifier 20 and accurately read, it is therefore necessary that the signal level at the output terminal 26 of the operational amplifier 20 be precisely at a known and predictable level at the beginning of the set phase of each integration cycle.

OBJECTS OF THE INVENTION

Accordingly, it is a primary object of the present invention to provide apparatus for and a method of providing a solution to the foregoing problems.

Another object of the present invention is to provide in an information channel including an integrating operational amplifier for converting charge signals to voltage signals and an analog autozeroing circuit at the output of the integrating operational amplifier to eliminate the effects of spurious phenomena that result in an unknown starting level of the output of the integrator at the beginning of each integration cycle.

Yet another object of the present invention is to provide apparatus for autozeroing a plurality of data channels.

Still another object of the present invention is to provide an autozeroing circuit that permits one to make reliable measurements of extremely low level data signals.

SUMMARY OF THE INVENTION

To effect the foregoing and other objects, the present invention generally is an autozero compensator circuit for an information channel including (a) a charge-to-voltage converter including switching circuitry operative to periodically acquire input charge signals during a set phase of a operation cycle, and reset the converter during a reset phase of the operation, and (b) processing circuitry for processing output signals from the converter. The autozeroing circuit comprises a storage capacitor connected between the output of the converter and the input of the processing circuitry, and means for selectively clamping the input of the processing circuitry to system ground during each reset phase of the operation cycle so as to provide a known signal level input to the processing circuitry at the beginning of each set phase of the operation cycle independent of prior activities, such as the presence of charge injection and the Boltzman noise due to switching in the converter.

BRIEF DESCRIPTION OF THE DRAWINGS

For a fuller understanding of the nature and objects of the present invention, reference should be had to the following detailed description taken in connection with the accompanying drawings wherein like numerals denote like parts.

DETAILED DESCRIPTION OF THE DRAWINGS

Figure 1:
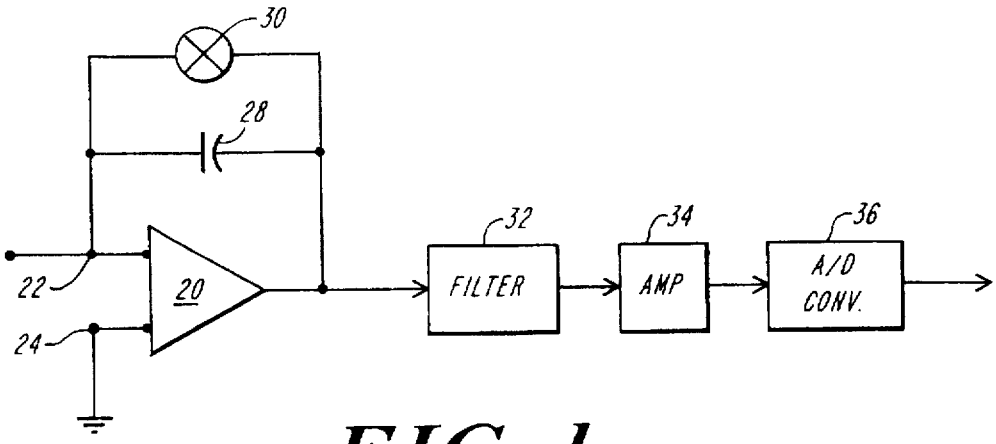
FIG. 1 (PRIOR ART)
FIG. 1 is a schematic diagram illustrating a prior art circuit for converting signal charges into digitized form.
Figure 2:
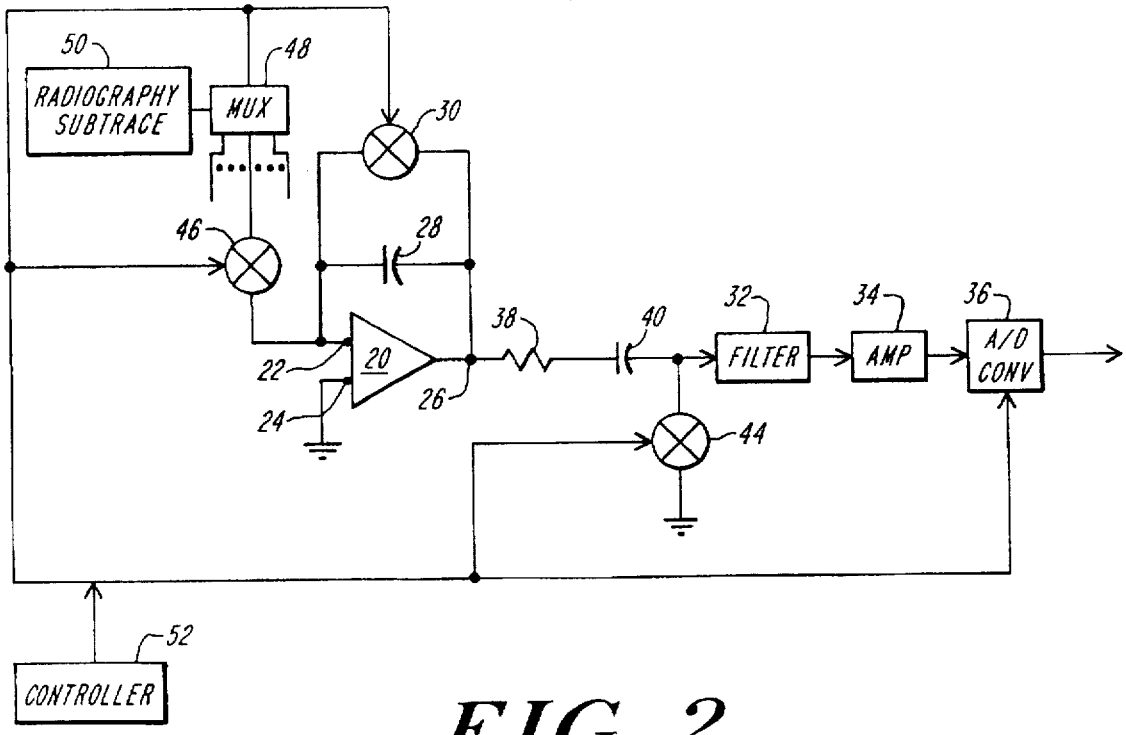
FIG. 2 is a schematic diagram illustrating an autozeroing circuit constructed according to the principles of the present invention.

As shown in FIG. 2, a preferred embodiment of the present invention includes a charge-to-voltage converter or integrator forming part of a data or information channel. Such an integrator and its operation is exemplified by the same type of integrator and its operation shown and described in connection with FIG. 1, wherein integrating operational amplifier 20 has inverting input terminal 22, non-inverting input terminal 24 connected to system ground, output terminal 26, integrating feedback capacitor 28 connected in a negative feedback path between terminals 26 and 22, and switch means such as FET reset switch 30 connected in parallel to capacitor 28. In accordance with the present invention output terminal 26 is connected through series resistor 38 and capacitor 40 to input terminal 42 of filter 32, terminal 42 also being connectable through switch 44 to ground. Filter 32 is preferably a low-pass filter provided with a large time constant. As in FIG. 1, the output of filter 32 is connected to the input of amplifier 34 and the output of the latter is connected to A/D converter 36 which provides a digital output signal representative of the input applied to the input of the converter.

As earlier noted, the present invention finds particular utility in reading out a computed radiology substrate, shown as block 50 in FIG. 2, which is applied to a multiplexer 48, although the system is designed to be used in any type of computed radiology system for recording latent images. The multiplexer 48 typically provides a plurality of data input channels. A representative one of such channels is shown in FIG. 2 as connected to a FET input switch 46 for connecting the data channel to input terminal 22 of charge-to-voltage converter 20. The circuit of the present invention is intended to be used to process a sequence of signals received on its input channel, such as signals derived by scanning computed radiology substrate 50, the source of such sequence of signals being shown generally simply as multiplexer 48 which receives signals from the substrate 50. A controller 52 controls the switching sequence of the multiplexer 48, and switches 30, 44 and 46.

In operation, when switch 30 is closed, operational amplifier 20 is reset and charge on capacitor 28 is drained. When switch 46 is then closed and switch 30 is opened, a charge from plate 50, applied through multiplexer 48, is imposed on input terminal 22. However, closing the switch 30 causes the injection of charge from the capacitor into the output terminal 26. The amount of the latter charge depends on voltage used to control switch 30, as well as the internal capacitance in the switch. This parasitic charge can be as much as 5 picocoulombs creating a transient voltage at output terminal 26. Such voltage can be several times larger (e.g. as much as 5 times) than the size of the input signal. In addition, the Boltzman noise from capacitor 28 can create an unknown signal level at the output terminal 26 at the beginning of each operation or integration cycle when the switch 30 is open.

Thus, the circuit of the present invention includes capacitor 40 and switch 44. Keeping the latter closed when switching switch 30, serves to clamp the output of operational amplifier 20, so that when switch 30 is open the output of the integrator circuit starts at a known level, i.e., zero regardless of the charge injection attributed to the switching and the Boltzman noise attributed to capacitor 28. Any artifacts and noise are therefore ignored, but the charging and discharging of capacitor 40 and the switching of switch 44 will inject Boltzman noise and create additional artifacts at the input of filter 32. By keeping the value of capacitor 40 large, one eliminates the DC component and the values of $kT/C_{40}$ and $Q/C_{40}$ will be small. When switch 44 is closed to connect capacitor 40 to ground the time constant is small, but when opened the time constant is large.

Thus, when the switch 30 is open and amplifier 20 functions as an integrator, the output of amplifier 20 at terminal 26 rises to a voltage determined by the signal charge accumulated on feedback capacitor 28, and that voltage signal, representative of the input signal, is applied for further processing by amplifier 34 and D/A converter 36. During this time the switch 44 is opened so that the signal output of the integrator is applied to the input of the filter 32. When switch 30 is closed to clear the feedback capacitor 28 the switch 44 is also closed to clamp the input to filter 32 to ground. Thus, at the beginning of the set phase of the integration cycle, just prior to switches 30 and 44 opening, the input to filter 32 will be connected to system ground, negating any effects due to charge injection, Boltzman noise, and any other noise and artifacts effecting the signal level at that point in the circuit.

Summarizing, the present invention is particular useful in a circuit of the type including two stages, a front stage (integrator) which is sensitive to the desired signal, and a second stage which includes the filter 32, amplifier 34 and A/D converter 36. The first stage treats extremely small signals, and has problems arising out of switches that open and close; with small capacitances: significant noise associated with the reset of small capacitance (kT/C noise); and other artifacts and noise effecting the signal level at the input of the filter 32 at the beginning of each integration cycle. Although noise cannot be compensated for by digital calibration, artifacts can be, but the artifacts may be so large as to be outside the range of the A/D converter. Thus, capacitor 40 having a comparatively large capacitance (e.g. 10,000 picofarads for a circuit made of discrete components) is used to connect the two stages to separate the two, and amplifier 34 can scale the signals stored on capacitor 40 to the dynamic range of A/D converter 36. On the second stage side of capacitor 40 is switch 44 which serves to clamp the input to the second stage to ground during all times there is switching in the first stage of the circuit which causes noise and artifacts to occur. As soon as switching activity in the first stage is over, switch 44 is opened and the second stage will track the first stage. Thus, the noise and artifacts which occur during switching in the first stage do not affect the signal processing of the second stage.

Since certain changes may be made in the above apparatus without departing from the scope of the invention herein involved, it is intended that all matter contained in the above description or shown in the accompanying drawings shall be interpreted in an illustrative and not in a limiting sense.

What is claimed is:

1. In an information channel including a charge-to-voltage converter including switching circuitry so that converter converts charge to a voltage during a controlled conversion cycle including set and reset phases, and processing circuitry for processing output signals from said converter, an autozeroing circuit comprising, in combination:

capacitive means for storing the output signals connected between the output of said converter and the input of said processing circuitry; and means for selectively connecting and disconnecting said input of said processing circuitry to system ground so as clamp said input during the reset phase of said conversion cycle, and for unclamping said input so as to permit the input to said processing circuitry to be at a known level at the start of the set phase of each conversion cycle.

2. An autozeroing circuit as defined in claim 1, wherein said converter comprises an integrating operational amplifier having inverting and non-inverting input terminals and an output terminal, a feedback capacitance connected between said inverting and output terminals, and a reset switch connected in parallel with said feedback capacitance for controlling the conversion cycle.

3. An autozeroing circuit as defined in claim 2, wherein said capacitive means comprises:

a resistor connected to the output terminal of said amplifier; and a capacitor, one side of which is connected in series to said resistor, the other side of which is connected to said input of said processing circuitry; and wherein said means for selectively connecting comprises:

switch means for connecting the other side of said capacitor to ground.

4. An autozeroing circuit as defined in claim 2, wherein said processing circuitry comprises, in series, a low-pass filter with a large time constant, and amplifier means.

5. An autozeroing circuit as defined in claim 4, wherein said processing circuitry comprises, in series with said amplifier means, analog-to-digital converter means.

6. An autozeroing circuit as defined in claim 2, wherein said feedback capacitance has a relatively much smaller capacitance than said capacitive means.

7. An autozeroing circuit as defined in claim 2, wherein said means for selectively connecting and disconnecting comprises at least one FET.

8. A method of autozeroing the input of processing circuitry connected to the output of a charge-to-voltage converter including switching circuitry for repetitively charging and discharging charge storage means in said converter through a set and reset phases of an operation cycle, said method comprising the step of:

selectively connecting and disconnecting said input of said processing circuitry to system ground so that said input of said processing circuitry is clamped to system ground prior to the operation of said switching circuitry when charging said charge storage means during said set phase so that said input of said processing circuitry starts from a known level independently of switching circuit and the charging and discharging of said charge storage means at the commencement of each operation cycle and receives the output of said converter during the charging of said charge storage means during the set phase.

* * * * *